US010138608B2

(12) United States Patent
Cho

(10) Patent No.: US 10,138,608 B2
(45) Date of Patent: Nov. 27, 2018

(54) APPARATUS FOR REMOVING SNOW THROUGH LIQUEFACTION

(71) Applicants: DAEJI PRECISION INDUSTRIES COMPANY LIMITED, Yongin-si Gyeonggi-do (KR); Hang Woo Cho, Seongnam-si, Gyeonggi-do (KR)

(72) Inventor: Hang Woo Cho, Seongnam-si (KR)

(73) Assignees: DAEJI PRECISION INDUSTRIES COMPANY LIMITED, Yongin-si, Gyeonggi-do (KR); Hang Woo Cho, Seongnam-si, Gyeonggi-do (KR)

( * ) Notice: Subject to any disclaimer, the term of this patent is extended or adjusted under 35 U.S.C. 154(b) by 48 days.

(21) Appl. No.: 15/325,757

(22) PCT Filed: Mar. 3, 2015

(86) PCT No.: PCT/KR2015/002020
§ 371 (c)(1),
(2) Date: Jan. 12, 2017

(87) PCT Pub. No.: WO2016/017888
PCT Pub. Date: Feb. 4, 2016

(65) Prior Publication Data

US 2017/0152639 A1 Jun. 1, 2017

(30) Foreign Application Priority Data

Jul. 31, 2014 (KR) ..... 10-2014-0097993

(51) Int. Cl.
*E01H 5/10* (2006.01)
*E01H 5/08* (2006.01)

(52) U.S. Cl.
CPC ..... *E01H 5/104* (2013.01); *E01H 5/08* (2013.01); *E01H 5/106* (2013.01)

(58) Field of Classification Search
CPC ..... E01H 5/104; E01H 5/106; E01H 5/10; E01H 5/08
See application file for complete search history.

(56) References Cited

U.S. PATENT DOCUMENTS 1,351,542 A * 8/1920 Ryan ..... E01H 5/104 126/343.5 R
1,821,292 A * 9/1931 Chase ..... E01H 5/104 126/343.5 R (Continued)

FOREIGN PATENT DOCUMENTS

JP 3136475 B2 2/2001
JP 2007-520655 A 7/2007

(Continued)

OTHER PUBLICATIONS

English Translation of the Written Opinion of the International Search Authority for PCT/KSR2015/0002020 (dated Mar. 17, 2015), EPO Global Dossier <https://register.epo.org/ipfwretrieve?apn=KR.2015002020.W&Ing=en>, Retrieved: Apr. 5, 2018 (Year: 2015).*

*Primary Examiner* — Thomas B Will
*Assistant Examiner* — Joan D Misa
(74) *Attorney, Agent, or Firm* — Rabin & Berdo, P.C.

(57) ABSTRACT

The present invention relates to an apparatus for removing snow through liquefaction, and the objective of the present invention is to provide an apparatus for removing snow through liquefaction that can melt snow suctioned by a snow suction means into water, thereby enhancing energy efficiency. The apparatus comprises: a snow suction means that includes a stirring part that forcibly crushes and stirs external snow and a suction part that forcibly suctions the snow that is stirred in the stirring part; a water spray means that sprays water into the suction part to melt the snow suctioned by the snow suction means; a storage part that stores the water into which the snow is melted by the water spray (Continued)

means; and a heating means that is located below the storage part and applies heat to the water stored in the storage part, wherein the heated water in the storage part is pumped and supplied to the water spray means.

14 Claims, 7 Drawing Sheets

(56) References Cited

U.S. PATENT DOCUMENTS 2,259,120 A * 10/1941 Sweeney ..... E01H 5/108 126/271.2 A
3,353,286 A * 11/1967 Marks ..... E01H 5/104 126/343.5 R
3,456,368 A * 7/1969 Lucien ..... E01H 1/108 126/343.5 R
3,619,918 A * 11/1971 Morin ..... E01H 5/104 126/343.5 R
3,766,586 A * 10/1973 Krickovich ..... E01H 1/0845 15/340.3
3,964,183 A * 6/1976 Mouat ..... E01H 5/108 219/220
4,071,966 A * 2/1978 Cohen ..... E01H 5/098 193/31 A
5,561,921 A * 10/1996 Vanderlinden ..... E01H 1/001 15/78
5,630,286 A * 5/1997 Vanderlinden ..... E01H 1/001 15/322
6,305,105 B1 * 10/2001 Lowman ..... E01H 5/104 37/199
7,073,974 B2 * 7/2006 Lichtblau ..... E01C 23/206 404/111
9,284,702 B2 * 3/2016 Lee ..... E01H 5/104
10,006,182 B1 * 6/2018 Cho ..... E01H 5/104
2004/0074114 A1 * 4/2004 Rogers ..... E01H 5/104 37/228
2005/0175411 A1 8/2005 Lichtblau
2010/0313451 A1 * 12/2010 Trubiano ..... E01H 5/104 37/228
2013/0219756 A1 * 8/2013 Lee ..... E01H 5/104 37/228
2016/0053452 A1 * 2/2016 Treglown ..... E01H 5/104 37/228

FOREIGN PATENT DOCUMENTS

KR 10-0477335 B1 3/2005
KR 10-2006-0108297 A 10/2006
KR 10-1310727 B1 9/2013

* cited by examiner

APPARATUS FOR REMOVING SNOW THROUGH LIQUEFACTION

TECHNICAL FIELD

The present invention relates to an apparatus for removing snow through liquefaction, and more particularly, to an apparatus for removing snow through liquefaction, which melts the snow suctioned by a snow suction means into water, thereby enhancing energy efficiency.

BACKGROUND ART

Generally, a method of removing snow deposited on a road in winter season includes a method in which calcium chloride, a chloride solution or the like is loaded in a cargo box of a vehicle and then sprayed using a sprayer while the vehicle travels along the road, a method in which a snowplow is installed at a front side of a vehicle and pushes the snow deposited on the road out of the road while the vehicle travels along the road, a method in which a relatively large amount of snow is forcibly suctioned using a snow blower (a blower-type snow removing machine) and then thrown to a side of the road, a method in which the snow on the road is melted by hot wind blowing from the vehicle and so on.

Among the methods, the method in which the calcium chloride or the chloride solution is sprayed has a problem that it takes a long time to have a chemical action with the snow, and the method in which the deposited snow is pushed out of the road or the method using the snow blower is just moving of a deposition location of the snow by scattering the snow to an adjacent area and corresponds to a snow removing purpose for emergency traffic but has a problem that the deposited snow is not completely removed, and the method in which the snow on the road is melted by the hot wind may have an excellent melting effect when a small amount of snow is deposited but has a problem that the melting effect due to the hot wind is degraded when a large amount of snow is deposited or frozen.

As an example of a conventional snow removing apparatus to solve the problems, there is an "apparatus for removing snow through liquefaction" disclosed in Korean Patent Publication No. 10-2006-0108297.

FIG. 1 is a view illustrating an apparatus for removing snow through liquefaction according to the prior art.

Referring to FIG. 1, the apparatus for removing snow through liquefaction according to the prior art includes a snow removing chamber 1 having a snow introduction port 1*a* through which external deposited snow is introduced and a drain hole 1*b*, an immersion part 2 which stores the snow introduced into the snow removing chamber 1 and stores water liquefied in the snow removing chamber 1, a hot wire 3 which heats the snow and water stored in the immersion part 2, a snow suction means 4 including a suction part 4*a* which forcibly suctions and supplies the external snow to the snow introduction port 1*a* and a stirring part 4*b* which forcibly crushes and stirs the snow deposited on the road to supply the snow to the suction part 4*a*, and a hot air means 5 which supplies hot air into an inner space of the snow removing chamber 1 and liquefies the snow.

Also, the suction part 4*a* includes a suction duct 4*a*-1 which is in communication with the snow introduction port 1*a* of the snow removing chamber 1, an impeller 4*a*-2 which forcibly suctions the external snow into the suction duct 4*a*-1 and a driving motor 4*a*-3 which drives the impeller 4*a*-2.

In the apparatus for removing snow through liquefaction according to the prior art as described above, when the stirring part is axially rotated while being located adjacent to the ground at a predetermined distance, the deposited snow is crushed and scattered toward the impeller 4*a*-2. At this point, the impeller 4*a*-2 forcibly suctions and supplies the snow into the suction duct 4*a*-1.

The snow passed through the suction duct 4*a*-1 is injected into the snow removing chamber 1 through the snow introduction port 1*a*. The snow injected into the snow removing chamber 1 is melted and dropped by the hot air discharged from the hot air means 5.

Water drops dropped by the hot air is collected in the immersion part 2, and the water overflowing the immersion part 2 is discharged to an outside through the drain hole 1*b* and melts the snow remaining at a rear of the snow removing chamber 1.

Also, the snow in the snow removing chamber 1 which is not still melted by the hot air is dropped into the immersion part 2 and then melted by contact with a water surface in the immersion part 2. At this point, the hot wire 3 may be heated and thus may increase metability of the snow by heating the water in the immersion part 2.

However, in the apparatus for removing snow through liquefaction according to the prior art, there is a problem that the snow is dropped into the snow removing chamber 1 and liquefied by the hot wire 3 in the immersion part 2, and a high calorific value is required to liquefy the snow and thus a lot of energy is consumed by driving the hot air means 5.

That is, it takes a considerably time to melt the snow introduced into the snow removing chamber 1, and the high calorific value is also consumed by heating a large amount of melted water stored in the immersion part 2, and thus there is a problem that there is a limit to a heating temperature of the melted water and the metability is degraded due to a low temperature of the melted water.

DISCLOSURE

Technical Problem

The present invention is directed to providing an apparatus for removing snow through liquefaction, which melts the snow suctioned by a snow suction means into water, thereby enhancing energy efficiency.

Technical Solution

One aspect of the present invention provides an apparatus for removing snow through liquefaction, including a snow suction means including a stirring part configured to forcibly crush and stir external snow and a suction part configured to forcibly suction the snow stirred in the stirring part; a water spray means configured to spray water into the suction part to melt the snow suctioned by the snow suction means; a storage part configured to store the water into which the snow is melted by the water spray means; a heating means located under the storage part and configured to apply heat to the water stored in the storage part; and a moving means which is movable in a state in which the snow suction means, the water spray means, the storage part and the heating means are loaded therein, wherein the heated water in the storage part is pumped and supplied to the water spray means.

The water spray means may include a pipe line configured to connect the storage part with the snow suction means and a pump installed at the pipe line.

The water spray means may include a pipe line of which one end is connected to the storage part and a hopper in which the snow dropped from the snow suction means is provided and also may include a venturi tube of which a cross section of an inner path is reduced to be smaller than that of each of an inlet port and an outlet port and a pump installed at the pipe line.

The water spray means may include a pipe line configured to connect the storage part with the snow suction means, a pump installed at the pipe line and a hopper of which one end is branched to the pipe line and in which the snow dropped from the snow suction means is provided and also may include a venturi tube of which a cross section of an inner path is reduced to be smaller than that of each of an inlet port and an outlet port.

The storage part may include an inner storage part formed in a box shape to store the water and having a plurality of discharge holes through which the water is discharged when overflowing an upper portion thereof and an outer storage part formed outside the inner storage part to be spaced apart at a predetermined distance and in which the water discharged through the discharge holes is stored and heated by the heating means.

The heating means may include a burner in which a fuel is supplied and burned, a first header which is horizontally disposed under the storage part to inject combustion heat from the burner and a plurality of exhaust pipes of which one ends are connected to the first header to discharge the combustion heat.

The apparatus may further include a second header to which the other end of the exhaust pipe is connected to integrate exhaust heat and a heating part of which one end is connected to the second header to supply the exhaust heat around the snow suction means and also to discharge the exhaust heat to an outside.

The apparatus may include a moving means which is movable in a state in which the snow suction means, the water spray means, the storage part and the heating means are loaded therein.

The moving means may be a vehicle.

A water spray line may be installed at each of the discharge holes formed at the storage part to spray the water by the pump, and a suction line may be installed at the venturi tube.

A second water supply line which is branched from the pipe line to spray the water may be installed inside the hopper of the venturi tube.

A second heating part through which the heat exhausted from the heating means passes may be installed outside the hopper of the venturi tube.

A heating plate for evaporating the water may be installed at the inner storage part.

Advantageous Effects

According to the apparatus for removing snow through liquefaction of the present invention, the water is sprayed with the water spray means to the snow suctioned by the snow suction means and then stored in the storage part, and the water in the storage part is heated by the heating means and then supplied to the water spray means to melt the snow suctioned by the snow suction means, and thus the energy efficiency can be enhanced.

MODES OF THE INVENTION

Hereinafter, exemplary embodiments of the present invention will be described in detail with reference to the accompanying drawings. The following exemplary embodiments are described in order to enable those of ordinary skill in the art to embody and practice the invention. However, the present invention may be embodied in many different forms and is not limited to the exemplary embodiments set forth herein.

Figure 1:
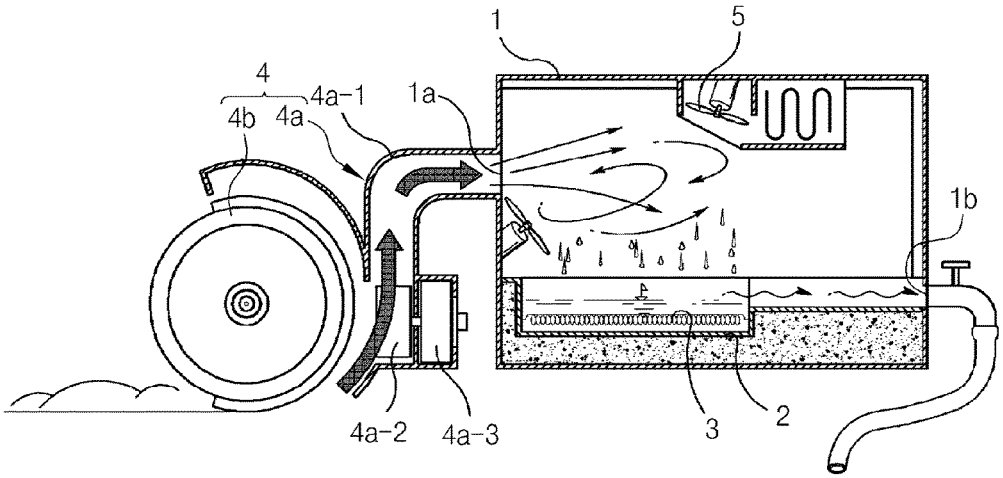
FIG. 1 (PRIOR ART)
FIG. 1 is a view illustrating an apparatus for removing snow through liquefaction according to the prior art.
Figure 2:
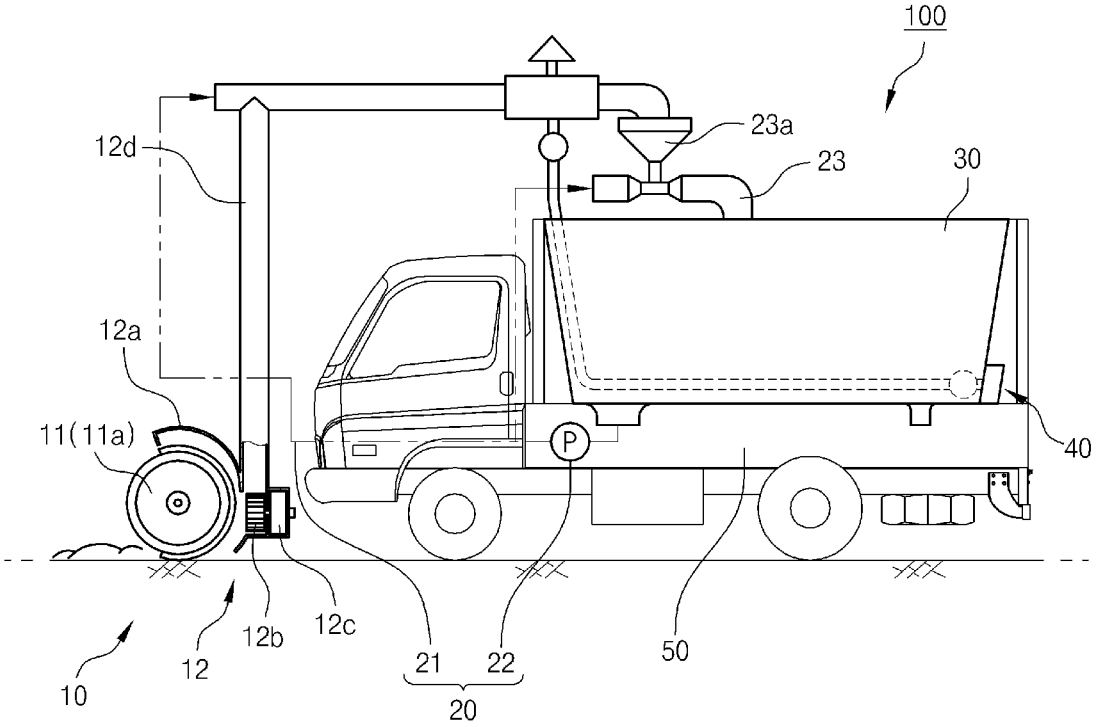
FIG. 2 is a front view illustrating a state in which an apparatus for removing snow through liquefaction according to the present invention is installed at a moving means.
Figure 3:
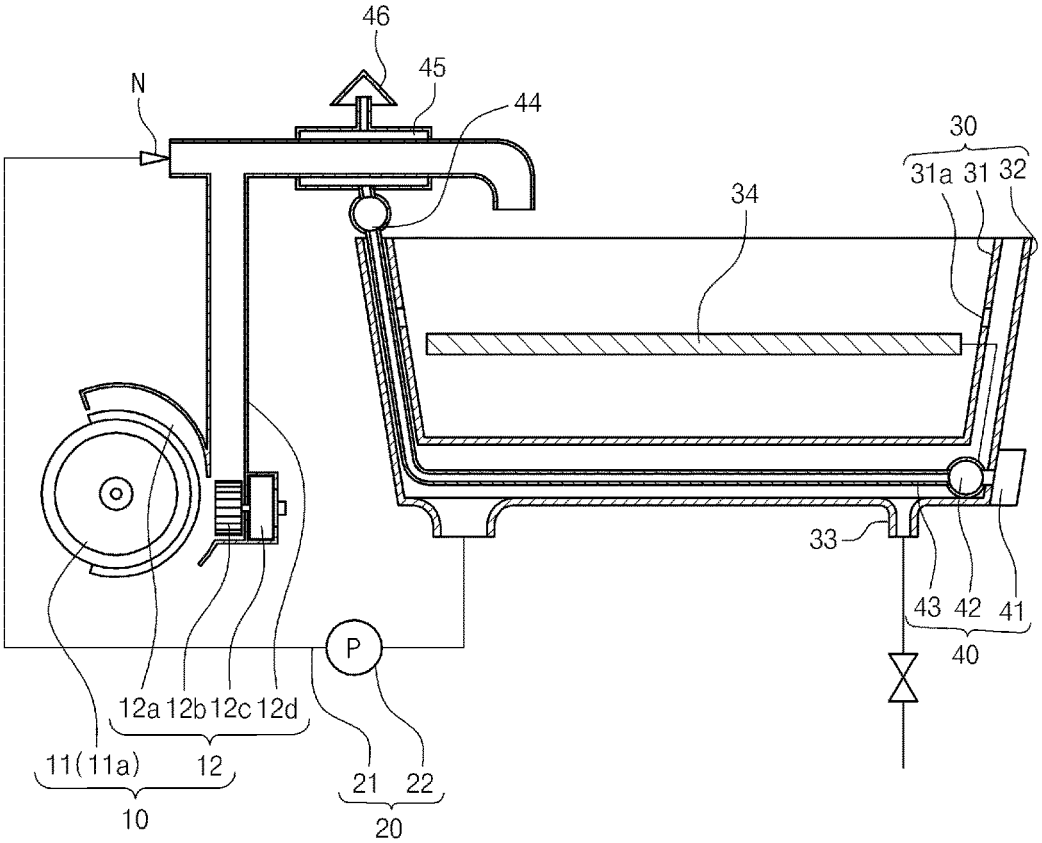
FIG. 3 is a cross-sectional view of the apparatus for removing snow through liquefaction according to the present invention and illustrates an example of a water spray means.
Figure 4:
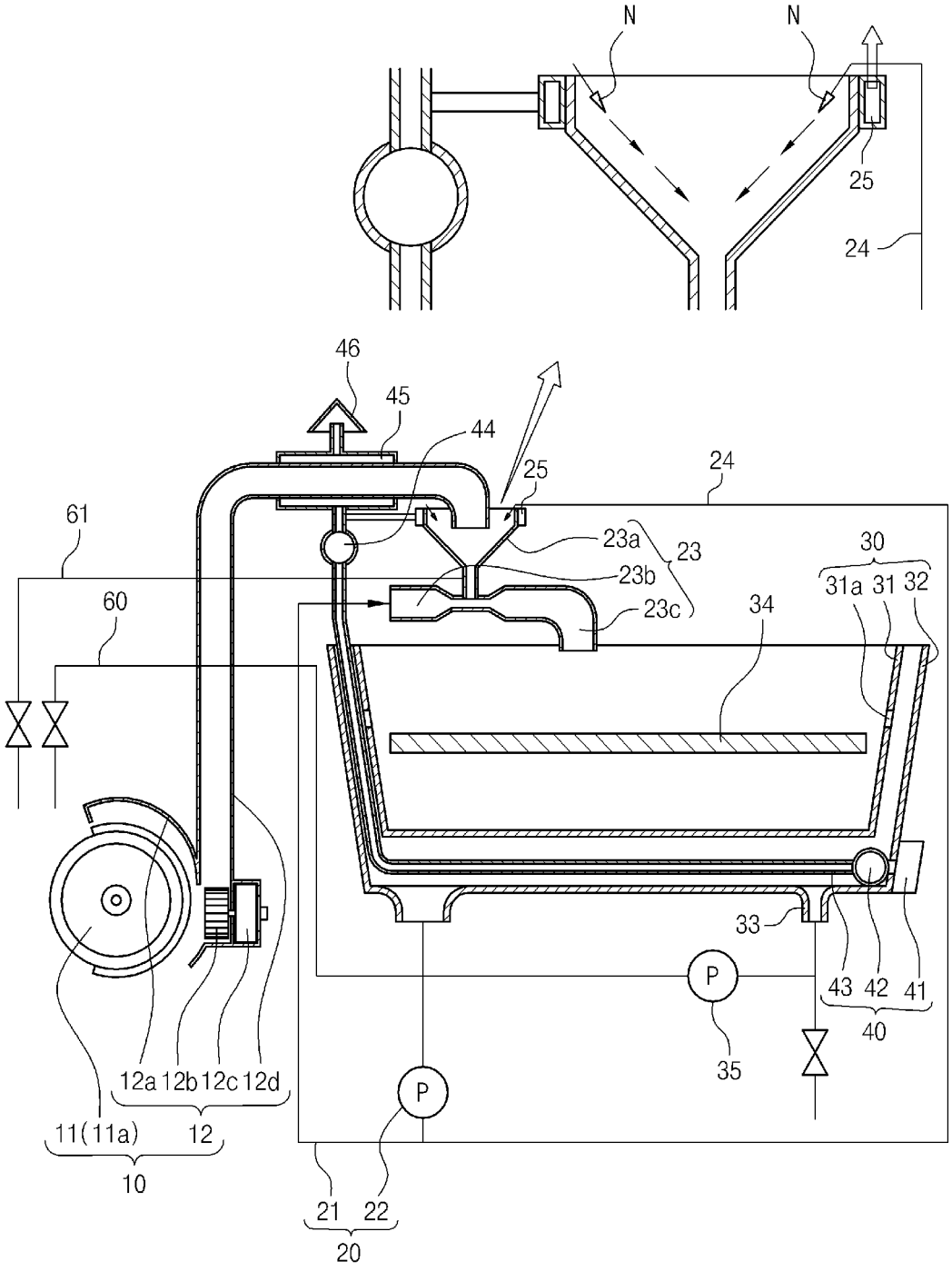
FIG. 4 is a cross-sectional view of the apparatus for removing snow through liquefaction according to the present invention and illustrates another example of the water spray means.
Figure 5:
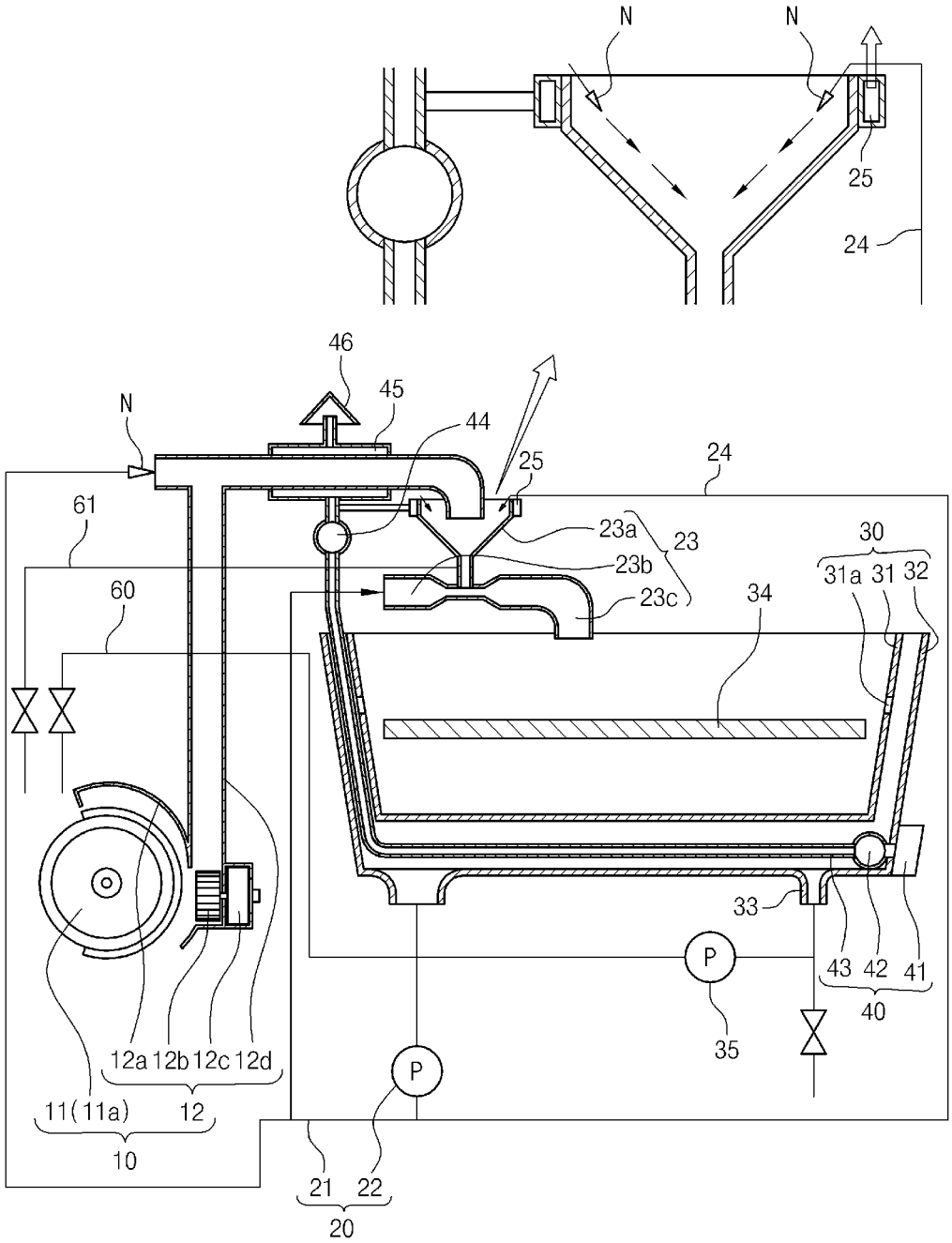
FIG. 5 is a cross-sectional view of the apparatus for removing snow through liquefaction according to the present invention and illustrates yet another example of the water spray means.
Figure 6:
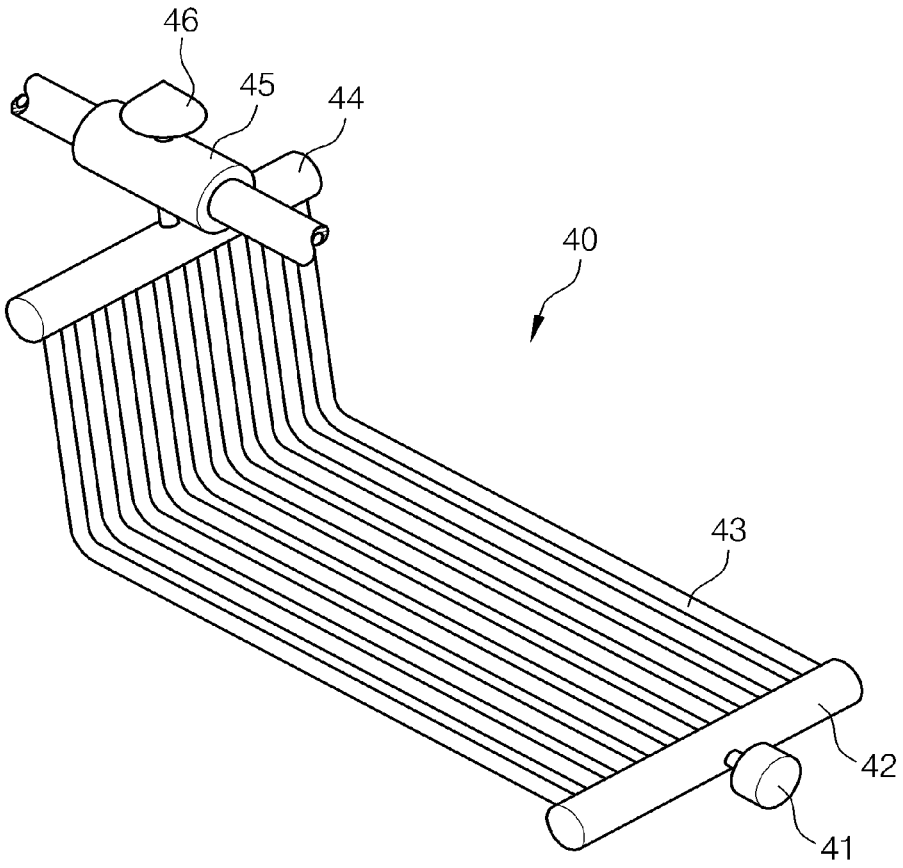
FIG. 6 is a perspective view illustrating a heating means of the apparatus for removing snow through liquefaction according to the present invention.
Figure 7:
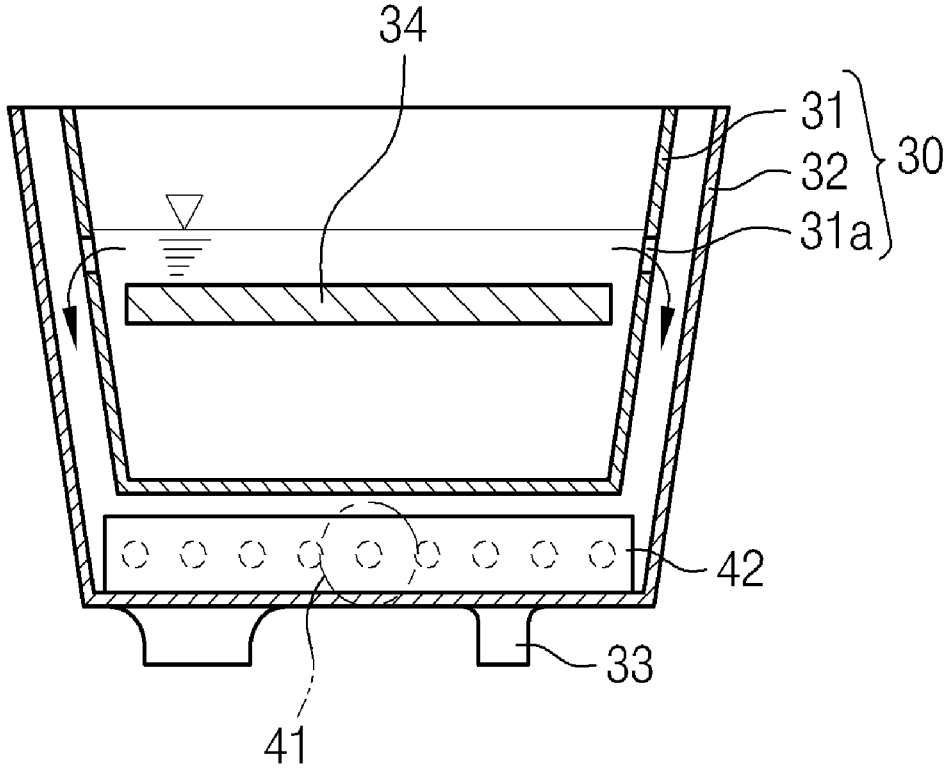
FIG. 7 is a side cross-sectional view of a storage part of the apparatus for removing snow through liquefaction according to the present invention.

FIG. 2 is a front view illustrating a state in which an apparatus for removing snow through liquefaction according to the present invention is installed at a moving means, FIG. 3 is a cross-sectional view of the apparatus for removing snow through liquefaction according to the present invention and illustrates an example of a water spray means, FIG. 4 is a cross-sectional view of the apparatus for removing snow through liquefaction according to the present invention and illustrates another example of the water spray means, FIG. 5 is a cross-sectional view of the apparatus for removing snow through liquefaction according to the present invention and illustrates yet another example of the water spray means, FIG. 6 is a perspective view illustrating a heating means of the apparatus for removing snow through liquefaction according to the present invention, and FIG. 7 is a side cross-sectional view of a storage part of the apparatus for removing snow through liquefaction according to the present invention.

Referring to FIGS. 2 to 7, the apparatus 100 for removing snow through liquefaction according to the present invention includes a snow suction means 10, a water spray means 20, a storage part 30, a heating means 40 and a moving means 50.

The snow suction means 10 serves to forcibly crush, stir and suction external snow and may include a stirring part 11 and a suction part 12.

Also, the stirring part 11 includes a stirring blade 11*a* which is axially rotated about a rotation center of a shaft in parallel with a road surface and forcibly crushes and stirs the external snow while being rotated by a stirring blade driving part (not shown).

Also, the suction part 12 includes a shroud 12*a* which covers one side of the stirring blade, an impeller 12*b* which is installed at one side inside the shroud 12*a* to be rotated by a driving motor 12*c*, and a suction path 12*d* which is connected from an end of the shroud 12*a* to the storage part 30.

Also, the snow suction means 10 may be changed into various types such as a screw, a skid roller, an excavator.

The water spray means 20 serves to spray water into the suction part 12 to melt the snow suctioned by the snow suction means 10 and includes a pipe line 21 which connects the storage part 30 with the snow suction means 10 and a pump 22 which is installed at the pipe line 21.

Also, a nozzle n is installed at an end of the pipe line 21 to spray the water into the suction part 12, more specifically, the suction path 12*d*.

That is, the water is sprayed onto the snow suctioned by the snow suction means 10 to liquefy and store the snow in the storage part.

The storage part 30 serves to store the water generated by melting the snow through the water spray means 20 and includes an inner storage part 31 formed in a box shape to store the water and having a plurality of discharge holes 31*a* through which the water is discharged when overflowing an upper portion thereof and an outer storage part 32 which is formed outside the inner storage part 31 to be spaced apart at a predetermined distance and in which the water discharged through the discharge holes 31*a* is stored and heated by the heating means 40.

That is, when the inner storage part 31 is filled with the water, the water overflows through the discharge holes 31*a*, flows to the outer storage part 32, is heated in the outer storage part 32 and then sprayed through the water spray means 20.

Also, a drain hole 33 is installed at the inner storage part 31 or the outer storage part 32 to discharge the stored water to an outside, if necessary.

Also, a heating plate 34 for evaporating the water may be installed at the inner storage part 31. The heating plate 34 may be formed so that a heating medium flows therein or may be formed to install a heat pipe or to receive heat by a burner 41 which will be described below.

The heating means 40 is located under the storage part 30 to heat the water stored in the storage part 30. The heating means 40 includes the burner 41 in which a fuel is supplied and burned, a first header 42 which is horizontally disposed under the storage part 30 to inject combustion heat from the burner 41 and a plurality of exhaust pipes 43 of which one ends are connected to the first header 42 to discharge the combustion heat.

Also, the heating means 40 includes a second header 44 to which the other ends of the exhaust pipes 43 are connected to integrate exhaust heat and a heating part 45 of which one end is connected to the second header 44 to supply the exhaust heat around the snow suction means 10 and also to discharge the exhaust heat to an outside.

Meanwhile, each of the exhaust pipes 43 according to the present invention may be connected to the heating part 45 without the second header 44.

Also, a flue 46 may be formed at an upper portion of the heating part 45 to discharge gas remaining in the burner 41 after burning to an outside.

The moving means 50 is movable in a state in which the snow suction means 10, the water spray means 20, the storage part 30 and the heating means 40 are loaded therein. The moving means 50 may be a vehicle and may also be formed in a separate cart shape or a shape in which a wheel or the like is installed at a small engine to be conveniently used in a road or the like that it is difficult for the vehicle to enter.

On the other hand, the apparatus 100 for removing snow through liquefaction according to the present invention may be installed in a fixed method without the moving means 50 to remove the snow moved and accumulated by a dump truck or the like.

Also, FIG. 4 illustrates another example of the water spray means 20 according to the present invention which includes a pipe line 21 of which one end is connected to the storage part 30 and a hopper 23*a* in which the snow dropped from the snow suction means 10 is provided and also includes a venturi tube 23 of which a cross section of an inner path is reduced to be smaller than that of each of an inlet port 23*b* and an outlet port 23*c* and a pump 22 which is installed at the pipe line 21.

Also, a water spray line 60 is installed at the drain hole 33 formed at the storage part 30, and a suction line 61 which may suction the water, the snow or the like is installed at the venturi tube 23 to suction the snow deposited on an area in which it is difficult for the moving means 50 to be moved or to suction the melted water after the snow is melted by the water sprayed from the water spray line 60, and thus the snow may be removed.

And the water spray line may be installed by branching a pipe from the pipe line 21.

Also, a second water spray line 24 which is branched from the pipe line 21 to spray the water may be installed at an inside of the hopper 23*a* of the venturi tube 23 to allow the snow to be removed.

Also, a second heating part 25 through which the heat discharged from the heating means 40 passes may be installed outside the hopper 23*a* of the venturi tube 23 to effectively use the exhaust heat.

In the embodiment, when the water flows through the venturi tube 23, the snow may be melted by the water while introduction of the snow provided from the hopper 23*a* is rapidly performed. The snow may be effectively removed through the water spray line 60 and the suction line 61 even at the area in which it is difficult for the moving means 50 to be moved, and a snow removing operation may be more effectively performed by installing the second water spray line 24 and the second heating part 25 inside and outside the hopper 23*a* of the venturi tube 23, respectively.

Also, FIG. 5 illustrates yet another example of the water spray means 20 according to the present invention which includes a pipe line 21 which connects the storage part 30 with the snow suction means 10, a pump 22 which is installed at the pipe line 21 and a hopper 23*a* of which one end is branched to the pipe line 21 and in which the snow dropped from the snow suction means 10 is provided and also includes a venturi tube 23 of which a cross section of an inner path is reduced to be smaller than that of each of an inlet port 23*b* and an outlet port 23*c*.

Meanwhile, in the embodiment, one embodiment is added to FIG. 4, and detailed description thereof will be omitted.

In the embodiment, the water is sprayed into the snow suction means 10 through the pipe line 21 by an operation of the pump 22 to melt the snow, and when the melted water is introduced again into the venturi tube 23 through the hopper 23*a*, a vacuum state is formed while the water is sprayed from the inlet port 23*b* of the venturi tube 23 and discharged to the outlet port 23*c* through the reduced cross section, and thus the snow may be more rapidly melted into the water.

The apparatus 100 for removing snow through liquefaction according to the present invention may be installed at the moving means 50 such as the vehicle to be movable. The snow suction means 10 is operated on the road on which the snow is deposited, and the external snow is forcibly crushed and stirred by operating the stirring blade 11*a* with the stirring blade driving part, and when the impeller 12*b* is driven by the driving motor 12*c*, the snow is suctioned by the impeller 12*b* and then introduced into the storage part 30 through the suction path 12*d*.

At this point, the water is sprayed to the introduced snow through the water spray means 20, and the water in the storage part 30 is sprayed into the suction path 12*d* by the pump 22 installed at the pipe line 21, or the snow dropped from the suction path 12*d* is injected into the hopper 23*a*, and when the water is sprayed into the inlet port 23*b* of the venturi tube 23, the snow injected into the hopper 23*a* is changed into the water while passing through the reduced cross section and being rapidly discharged to the outlet port 23*c* and then stored in the storage part 30, and the water spray means 20 may be simultaneously operated.

Meanwhile, the water stored in the storage part 30 is dropped into the inner storage part 31. When the water is increased to a predetermined level, the water is discharged to the outer storage part 32 through the discharge holes 31*a*. The water stored in the outer storage part 32 is heated by the heating means 40 and sprayed to the snow by the water spray means 20.

Also, the heating plate 34 for evaporating the water may be installed at the inner storage part 31, and thus the water therein may be evaporated by the heated heating plate.

In the heating means 40, the fuel is burned in the burner 41, and the combustion heat is introduced into the first header 42, and the combustion heat in the first header 42 exchanges heat with the water while moving through the exhaust pipes 43.

In addition, the combustion heat which exchanges heat through the exhaust pipes 43 is discharged to an outside. At this point, the combustion heat is discharged to the flue through the heating part 45 formed at the suction path 12*d* of the snow suction means 10, and a part of the exhaust heat exchanges heat while being discharged from the second heating part 25 outside the hopper 23*a* of the venturi tube 23, and thus the snow removing operation is effectively performed.

Also, the second water spray line 24 is installed inside the hopper 23*a* of the venturi tube 23 so that the snow or the water injected into the hopper is easily introduced into the venturi tube.

At the area in which it is difficult for the moving means 50 to be moved, the water is sprayed from the water spray line 60 branched from the pipe line 21 to melt the snow, and the water or the snow is suctioned through the suction line 61 connected to the reduced cross section of the venturi tube 23, and thus the snow removing operation is performed.

Although a few embodiments of the present invention have been shown and described, it would be appreciated by those skilled in the art that changes may be made in these embodiments without departing from the principles and spirit of the invention, the scope of which is defined in the claims and their equivalents.

DETAILED DESCRIPTION OF MAIN ELEMENTS

| | |
|---|---|
| 100: apparatus for removing snow through liquefaction | |
| 10: snow suction means | 11: stirring part |
| 11a: stirring blade | 12: suction part |
| 12a: shroud | 12b: impeller |
| 12c: driving motor | 12d: suction path |
| 20: water spray means | 21: pipe line |
| 22: pump | 23: venturi tube |
| 23a: hopper | 23b: inlet port |
| 23c: outlet port | 24: second water spray line |
| 25: second heating part | 30: storage part |
| 31: inner storage part | 31a: discharge hole |
| 32: outer storage part | 33: drain hole |
| 34: heating plate | 40: heating means |
| 41: burner | 42: first header |
| 43: exhaust pipe | 44: second header |
| 45: heating part | 46: flue |
| 50: moving means | 60: water spray line |
| 61: suction line | |

What is claimed is:

1. An apparatus for removing snow through liquefaction, comprising:

a snow suction means including a stirring part configured to forcibly crush and stir external snow and a suction part configured to forcibly suction the snow stirred in the stirring part;

a water spray means configured to spray water into the suction part to melt the snow suctioned by the snow suction means;

a storage part configured to store the water into which the snow is melted by the water spray means; and a heating means located under the storage part and configured to apply heat to the water stored in the storage part, the heating means including a burner in which a fuel is supplied and burned, a first header which is horizontally disposed under the storage part to inject combustion heat from the burner, a plurality of exhaust pipes of which one ends are connected to the first header to discharge the combustion heat, a second header to which the other end of the exhaust pipe is connected to integrate exhaust heat, and a heating part of which one end is connected to the second header to supply the exhaust heat around the snow suction means and also to discharge the exhaust heat to an outside, wherein the heated water in the storage part is pumped and supplied to the water spray means.

2. The apparatus of claim 1, wherein the water spray means includes a pipe line configured to connect the storage part with the snow suction means and a pump installed at the pipe line.

3. The apparatus of claim 1, wherein the water spray means includes a pipe line of which one end is connected to the storage part and a hopper in which the snow dropped from the snow suction means is provided and also includes a venturi tube of which a cross section of an inner path is reduced to be smaller than that of each of an inlet port and an outlet port and a pump installed at the pipe line.

4. The apparatus of claim 3, wherein a water spray line is installed at each of discharge holes formed at the storage part to spray the water by a pump, and a suction line is installed at the venturi tube.

5. The apparatus of claim 3, wherein a second water supply line which is branched from the pipe line to spray the water is installed inside the hopper of the venturi tube.

6. The apparatus of claim 3, wherein a second heating part through which the heat exhausted from the heating means passes is installed outside the hopper of the venturi tube.

7. The apparatus of claim 1, wherein the water spray means includes a pipe line configured to connect the storage part with the snow suction means, a pump installed at the pipe line and a hopper of which one end is branched to the pipe line and in which the snow dropped from the snow suction means is provided and also includes a venturi tube of which a cross section of an inner path is reduced to be smaller than that of each of an inlet port and an outlet port.

8. The apparatus of claim 7, wherein a water spray line is installed at each of discharge holes formed at the storage part to spray the water by a pump, and a suction line is installed at the venturi tube.

9. The apparatus of claim 7, wherein a second water supply line which is branched from the pipe line to spray the water is installed inside the hopper of the venturi tube.

10. The apparatus of claim 7, wherein a second heating part through which the heat exhausted from the heating means passes is installed outside the hopper of the venturi tube.

11. The apparatus of claim 1, wherein the storage part includes an inner storage part formed in a box shape to store the water and having a plurality of discharge holes through which the water is discharged when overflowing an upper portion thereof and an outer storage part formed outside the inner storage part to be spaced apart at a predetermined distance and in which the water discharged through the discharge holes is stored and heated by the heating means.

12. The apparatus of claim 11, wherein a heating plate for evaporating the water is installed at the inner storage part.

13. The apparatus of claim 1, further comprising a moving means which is movable in a state in which the snow suction means, the water spray means, the storage part and the heating means are loaded therein.

14. The apparatus of claim 13, wherein the moving means is a vehicle.

* * * * *